US007090632B2

(12) United States Patent
Jackson et al.

(10) Patent No.: US 7,090,632 B2
(45) Date of Patent: Aug. 15, 2006

(54) FOLDER WITH MULTIPLE-MOTOR DRIVE

(75) Inventors: Barry Mark Jackson, York, ME (US); Joseph Adrian St. Ours, Lee, NH (US)

(73) Assignee: Goss International Americas, Inc., Dover, NH (US)

( * ) Notice: Subject to any disclaimer, the term of this patent is extended or adjusted under 35 U.S.C. 154(b) by 0 days.

(21) Appl. No.: 10/799,245

(22) Filed: Mar. 12, 2004

(65) Prior Publication Data

US 2004/0185997 A1 Sep. 23, 2004

Related U.S. Application Data

(62) Division of application No. 09/795,075, filed on Feb. 23, 2001, now Pat. No. 6,752,751.

(51) Int. Cl.
*B31F 1/08* (2006.01)

(52) U.S. Cl. ..... 493/428; 493/432

(58) Field of Classification Search ..... 493/424, 493/428, 432, 427, 425, 426, 435; 270/43, 270/6, 21.1

See application file for complete search history.

(56) References Cited

U.S. PATENT DOCUMENTS

| | | | | |
|---|---|---|---|---|
| 1,870,544 A | | 8/1932 | Wood | |
| 4,715,846 A | * | 12/1987 | Zak | 493/10 |
| 5,242,367 A | | 9/1993 | Marmin | 493/359 |
| 5,405,126 A | * | 4/1995 | Mack | 270/6 |
| 5,443,437 A | | 8/1995 | Mack | 493/359 |
| 5,520,378 A | * | 5/1996 | Kepert et al. | 270/8 |
| 5,676,630 A | * | 10/1997 | Mayr | 493/424 |
| 5,921,906 A | | 7/1999 | Nagano | 493/428 |
| 6,019,714 A | * | 2/2000 | Stab | 493/429 |
| 6,165,118 A | | 12/2000 | Eckert | 493/425 |
| 6,251,053 B1 | * | 6/2001 | Lanvin et al. | 493/359 |
| 6,358,192 B1 | * | 3/2002 | Michalik | 493/424 |
| 6,367,792 B1 | * | 4/2002 | Chagnon | 270/5.02 |
| 6,408,748 B1 | | 6/2002 | Hajek et al. | 101/177 |

FOREIGN PATENT DOCUMENTS

| | | |
|---|---|---|
| DE | 4426987 | 10/1996 |
| EP | 0699524 | 3/1996 |
| EP | 1074500 | 2/2001 |
| EP | 0922661 | 3/2003 |
| JP | 0192669 | 2/1989 |
| JP | 04179671 | 6/1992 |

* cited by examiner

*Primary Examiner*—Sameh H. Tawfik
(74) *Attorney, Agent, or Firm*—Davidson, Davidson & Kappel, LLC

(57) ABSTRACT

A folder includes a first cylinder having at least one first gripper for holding signatures and at least one tucker for tucking the signatures to define a first fold, a second cylinder having at least one first jaw for holding the signatures at the first fold, a first motor driving the at least one first gripper, and a second motor separate from the first motor, the second motor driving the at least one tucker of the first cylinder and the at least one first jaw of the second cylinder.

4 Claims, 3 Drawing Sheets

FOLDER WITH MULTIPLE-MOTOR DRIVE

CROSS-REFERENCE TO RELATED APPLICATIONS

This application is a divisional of U.S. patent application Ser. No. 09/795,075, filed on Feb. 23, 2001; Now U.S. Pat. No. 6,752,751.

BACKGROUND OF THE INVENTION

1. Field of the Invention

The present invention relates generally to printing presses and more particularly to a folder for a printing press.

2. Background of the Invention

Web printing presses print a continuous web of material, such as paper. In a folder of the printing press, the continuous web is cut into signatures and then folded. Various types of folders are known in the art, one of which is a combination folder.

Generally, combination folders incorporate a series of cylinders that uniquely provide functions to complete different portions of the fold, with each cylinder able to perform one or more functions. In order to provide for different types of printed products, the relative positions of cylinders within the combination folder may be altered. FIG. 1 shows the basic cylinder construction for a combination folder, for example a tucking cylinder. The basic cylinder shown herein is known in the art and is provided here for improved understanding of the present invention. A first function part 1, such as a tucking section, is mounted directly to a shaft 2 of the cylinder by a first arm 3 and a second arm 4. The shaft 2 supports a first hollow hub 5 and second hollow hub 6, which run concentric to the shaft 2. First and second hollow hubs 5, 6, in turn, support a third arm 8 and a fourth arm 9, which support a second function part 7, for example a gripper section. The shaft 2 and each hub 5, 6 can be driven by first and second drive gears 10, 11, respectively, which can be phased with respect to each other using helical gears.

Existing combination folders typically require a fold mode change and incorporate air cylinders to slide the helical gears to a required position. The helical gears, which are keyed to the main cylinder bodies, in turn, phase the cylinder bodies. This is incorporated to phase one set of cylinder bodies with respect to the other.

A drawback of the air cylinder and helical gear structure is that the helical gears may fail to shift, or seize, when changing relative position. This is due to the weight of the cylinder bodies or from the hubs freezing to the shaft due to lack of lubricant or due to fretting corrosion.

In order to reduce the likelihood of seizing, periodic maintenance is performed on the combination folder. However, the maintenance is time-consuming and increases the downtime of the folder.

U.S. Pat. No. 5,405,126 purports to disclose a folder having at least a first longitudinal folding device, driven severing members, and a second longitudinal folding device to which folding copies are supplied via a section of a conveyor belt which is disposed over a second loadable copy delivery. The folder comprises drawing devices disposed upstream of the severing members in the web-and-copy direction, first drive means for separately and controllably driving said drawing devices, and second drive means for driving said severing members and said cross-folding devices. The folder further includes a separate drive for driving said outwardly swingable conveyor belts. The second longitudinal folding device comprises components, and may include a phase-controllable separate electric motor for driving said components. The second drive means is an electric-motor drive. From one of the cutting or severing cylinders, the drive of the electric motor is transmitted to a gear. By means of the gear, the drive drives a folding cylinder, from there to a folding-jaw cylinder and then to a gripper cylinder. Furthermore, the drive of the second longitudinal fold can also be effected by the electric motor.

The '126 patent has the disadvantage that the folding cylinder, folding-jaw cylinder, and gripper cylinder are driven by the same drive and, thus, adjustment and mode changes are difficult.

European Patent Application No. 0 699 524 A2 purports to disclose a printing unit with elements driven by dependent electric motors, identified by the letter M in the figures. Folding devices in figure twenty-two each have a separate motor that directly drives the folding cylinders in the folding devices. EP Patent No. EP 0 699 524 A2 has the disadvantage that one motor drives the folding cylinders of a folder, thus making phase changes difficult.

BRIEF SUMMARY OF THE INVENTION

An object of the present invention is to provide for a device and method for simplifying group jaw adjustment and mode changes. An additional or alternative object of the present invention is to provide a multiple motor drive for a combination folder.

"Gripper" and "jaw" as defined herein can include any type of gripping device or holding device for a signature, such as an edge gripper or a jaw.

The present invention provides a folder comprising:

a first cylinder having at least one first gripper for holding signatures and at least one tucker for tucking the signatures to define a first fold;

a second cylinder having at least one first jaw interacting with the at least one tucker for holding the signatures at the first fold;

a first motor driving the at least one first gripper; and a second motor separate from the first motor, the second motor driving the at least one tucker of the first cylinder and the at least one first jaw of the second cylinder.

With the two different drive motors, the phasing between the at least one first gripper and the at least one tucker can be altered through varying the angular relationship between the two motors, so as to set the fold location and thus the lap. No complicated gearing, clutches or air cylinders are required as in single motor devices. Moreover, the tuck-to-jaw relationship driven by the second motor is isolated from the first gripper and any cutting events, thus isolating torsional shock caused by the cutting. Tighter fold tolerances are possible.

Mode changes are also easier, as the motors can be altered to switch, for example, from a half-fold to a delta-fold.

The first motor also may drive at least one pair of cutting cylinders, and preferably two pairs of cutting cylinders, which may be connected by a phasing center to the first grippers. A phase between the cutting cylinders and the first grippers may be altered.

Preferably, the tuckers and the first jaws are connected by a phasing center for altering a phase therebetween. A group jaw adjust may phase the relative position of the jaws to the tucker.

The motors preferably are AC synchronous drives, which can make adjustments on the fly. One motor can be chosen as the main drive motor (reference), and the other motor changed with respect to the main motor.

In a preferred embodiment, the present invention provides a folder comprising:

cutting cylinders for cutting a web of material into signatures, a first cylinder having at least one first gripper for holding the signatures at a lead edge and at least one tucker for tucking the signatures to define a first fold;

a second cylinder having at least one first jaw for holding the signatures at the first fold and at least one second jaw for holding the signatures at a second fold;

a third cylinder having at least one second gripper for holding the signatures at the first fold and at least one second tucker for forming the second fold;

a first motor driving the cutting cylinders and the at least one first gripper;

a second motor independent from the first motor, the second motor driving the at least one tucker of the first cylinder, the at least one first jaw of the second cylinder, and the at least one second gripper of the third cylinder; and a third motor independent from the first and second motors, the third motor driving the at the one second law of the second cylinder and the at least one second tucker of the third cylinder.

The cut and grip action defines a first loop, the first tuck and first jaw and second grip defines a second loop, and the second tuck and second jaw a third loop.

With the three closed loops of the present invention the tuck to jaw relationship is isolated from the cutting cylinders, thus, the torsional shock to the gear train associated with the cut event is contained in the first drive loop. Moreover, variation in the fold normally attributed to the cut event is isolated, thereby, allowing tighter tolerances.

Preferably, each of the loops are synchronized with the other functional devices of the loops, for example, the first cutting cylinder pair, the second cutting cylinder pair, and the first gripper are synchronized with each other; the first tucker, the first jaw (second gripper), and the fourth gripper are synchronized with each other; and the second tucker and the second jaw (third gripper) can be synchronized with each other by virtue of a connecting gear train.

The second loop may phase with respect to the first loop, and the third loop may phase with respect to the second and first loop, so as to allow adjustments of the function devices of the different loops with respect to one another. Thus, lap adjustments and mode changes can be made without significant downtime. Phasing centers and idlers within the loops can provide for a further degree of freedom, for example a group jaw adjust. Different types of printed products can be accommodated. For example, by adjusting the lap, different lap distances can be accommodated, and by adjusting the group jaw, products of differing thicknesses can be manufactured. Mode adjustment, for example switching from a double-parallel fold to a delta fold, may also be accomplished by changing the angular relationship between the second loop and first loop and the angular relationship of the third and second loop with respect to the first loop.

The first loop may have a reference point, preferably the gripper, and all other functions and loops phase with respect to the reference point. Alternatively, the first and third loops could phase to the second loop, or the first and second loops to the third, however additional motion then is required as the print to cut would altered.

Preferably, one of the loops is removable for simpler folds, for example the third loop. Advantageously, removal of one of the loops simplifies the present invention, renders the present invention less susceptible to mechanical failure, and removes cost from an unwanted option.

All of the motors preferably AC synchronous motors providing power to the folder by connecting with one or more drive motor pinons. The AC synchronous motors provide the advantage of synchronizing the drive loops and providing power to the three drive loops. AC synchronous motors may also be uniquely associated with one of the functional devices, e.g., a first gripper spider gear, a first tucker spider gear, a second gripper (first jaw) spider gear, a third gripper (second jaw) spider gear, a second tucker spider gear, or a fourth gripper spider gear, thus, power can directly be applied to the function adjustment devices. By providing power directly to the functional, no extraneous parts are needed and less torque is lost through friction.

At least one of the motors preferably is supported directly a ground surface, so as to stabilize the position of the motor, hence, advantageously, the present invention is stabilized and angular mode changes are facilitated.

A motorized platform for changing the angular relationships between the first, second, and third loops may also be incorporated into the invention. The advantage thus provided is increased efficiency in mode changes and less operator intervention during the mode changes.

Phasing centers, i.e. two gear constructions having a compound gear between the two gears to alter a phase, and idler gears preferably are provided within the first, second and third loops to permit phasing between the elements within each loop.

In an alternate embodiment, the folder may include four independently driven motors, with one motor driving the cut cylinders, and another motor independently driving the first grippers. The second and third loops then each have a separate motor.

The present invention also provides for a method for cutting and folding printed products comprising the steps of:

driving with a first motor a first loop for cutting a signature and transferring the signature to a first gripper with a first motor;

driving with a second motor a second loop for tucking the signature into a first jaw and transferring the signature to a second gripper; and driving with a third motor a third loop for tucking the signature into a second jaw.

Preferably, the method includes altering a phase between at least the first and second loops, so as to set a lap or perform mode change.

The phasing preferably is performed on the fly, thus, providing the advantage of reduced machine downtime.

The present invention also provides a folder comprising a first cylinder having a first functional device and a second functional device and a second cylinder having a third functional device dependent on the second functional device. A first motor drives the first functional device and a second independent motor drives the second and third functional devices.

BRIEF DESCRIPTION OF THE DRAWINGS

A preferred embodiment of the present invention is described below by reference to the following drawings, in which.

DETAILED DESCRIPTION

Figure 1:
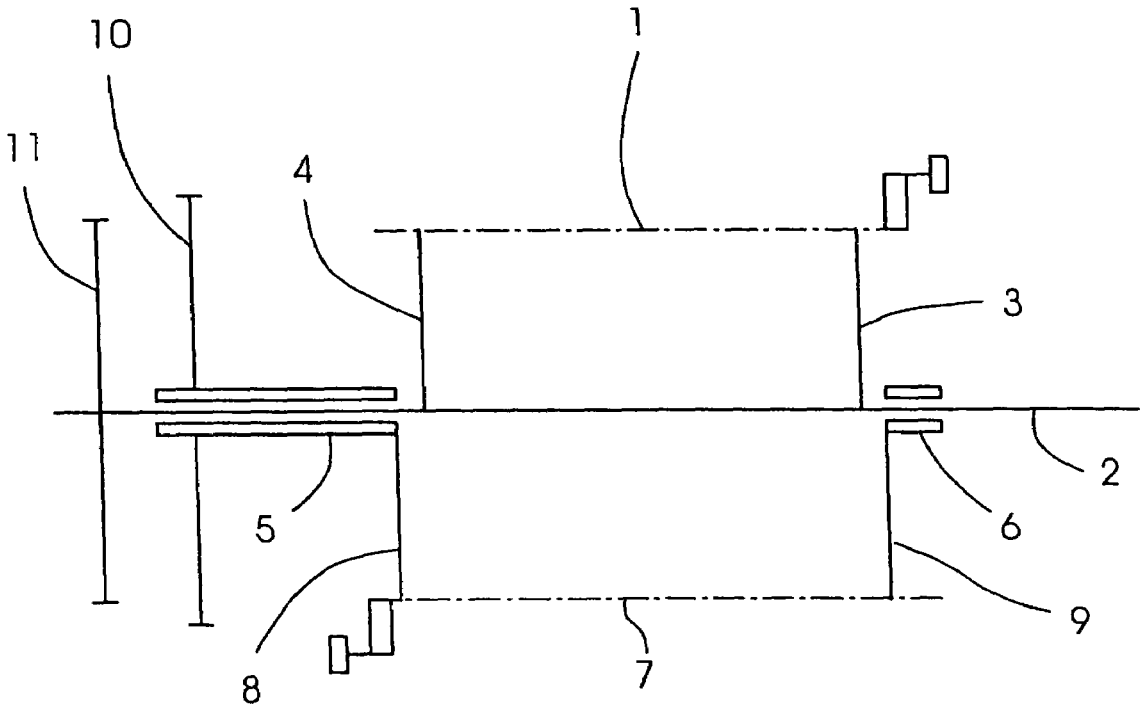
Fig.1 ( Prior Art )
FIG. 1 shows a basic cylinder construction for a prior art combination folder.
Figure 2:
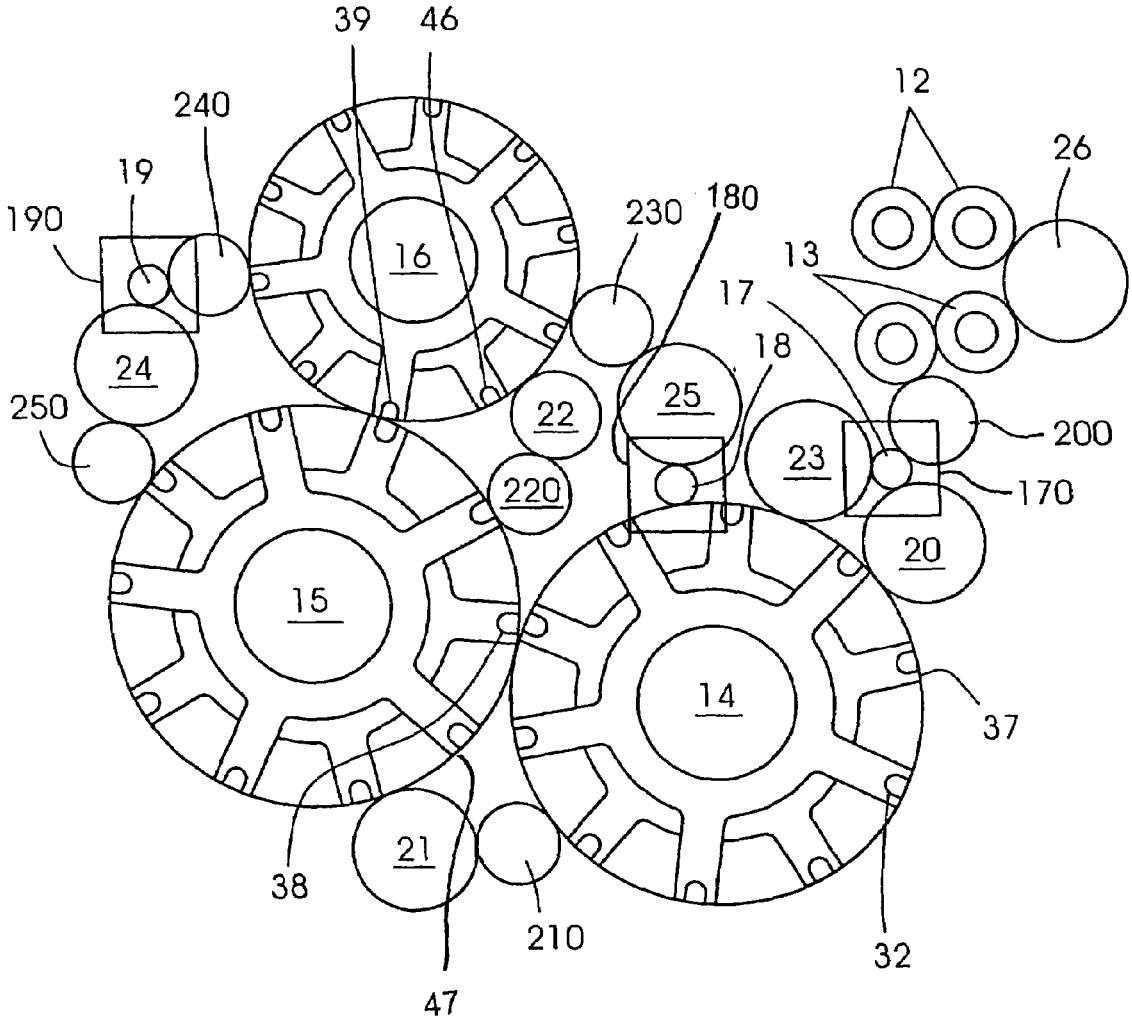
FIG. 2 shows a schematic gear side view of a combination folder of the present invention.

FIG. 2 shows a schematic side view of a preferred combination folder unit according to the present invention using a three-motor folder drive. The folder includes a first cutting cylinder pair 12 and a second cutting cylinder pair 13 for cutting a web of paper into signatures. The signatures are guided to a collect cylinder 14, where a lead edge of a signature is gripped by one of a plurality of first grippers 32. The signature is then rotated on collect cylinder 14 to pass a first fold cylinder 15. One of a plurality of tuckers 37 of collect cylinder 14 then tucks the signature near a mid-point into one of a plurality of first jaws 38 of first fold cylinder 15, as the first gripper 32 releases the lead edge of the signature.

The signature is thus cross-folded, with the first fold gripped by first jaws 38 of first fold cylinder 15 becoming the new lead edge of the signature. Cylinder 15 then rotates the signature past second fold cylinder 16, where one of a plurality of second grippers 39 grips the new lead edge (the first fold) and rotates the signature about cylinder 16. As the signature rotates, one of a plurality of second tuckers 46 tucks the once-folded signature near its new midpoint into one of a plurality of second jaws 47 of first fold cylinder 15. The double-parallel folded signatures then can be released by second jaws 47, for example to a further conveying device.

Figure 3:
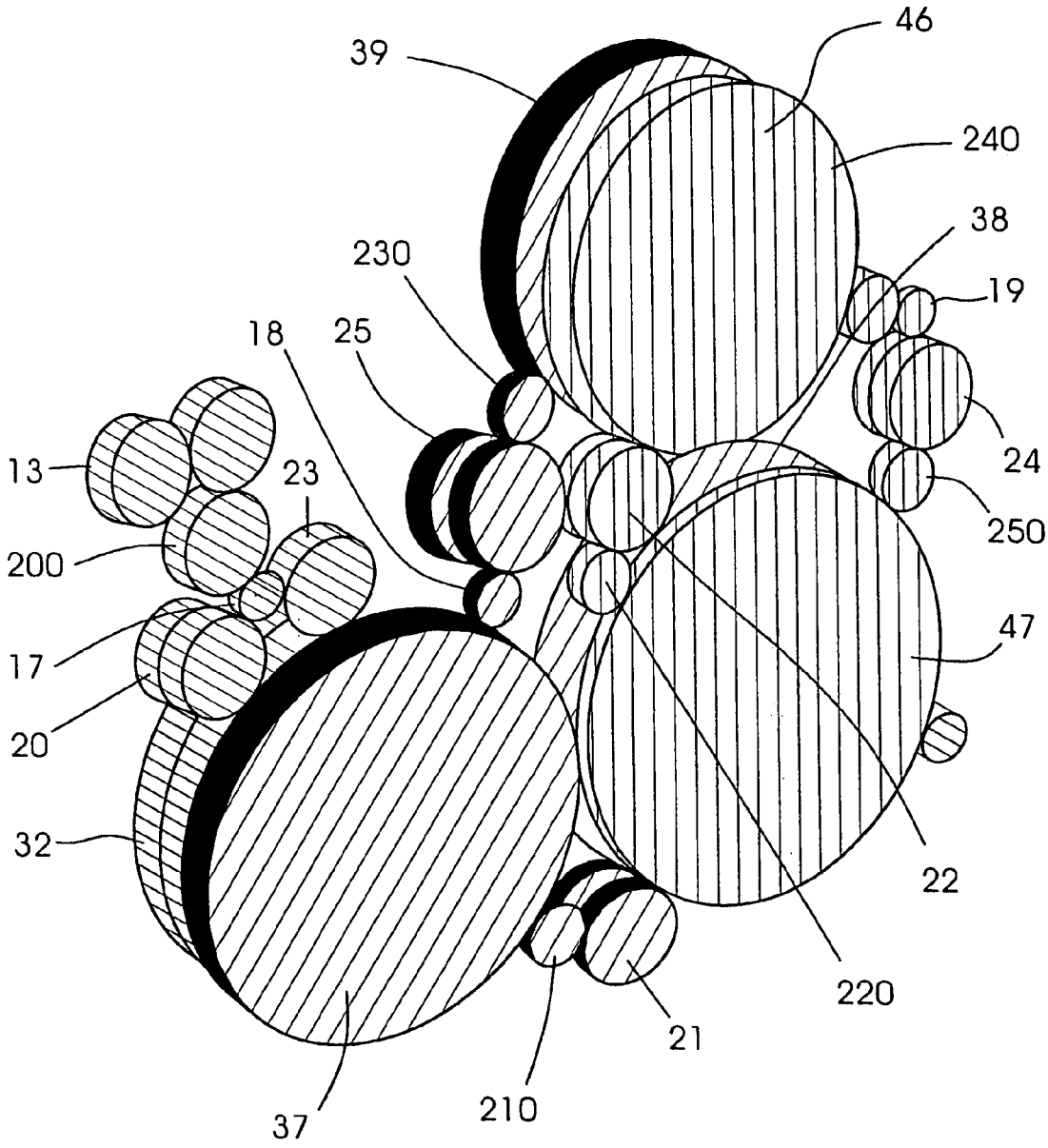
FIG. 3 shows an schematic view of the folder of FIG. 1 highlighting different driven elements.

The folder of the present invention is driven at three drive points 17, 18, 19 by three individual motors 170, 180, 190, respectively. FIGS. 2 and 3 show the different driving elements for the folder of FIG. 2. Drive point 17 drives a phasing center 20, which drives first grippers 32, for example using a spider gear. An anti-backlash gear 23 ensures that first grippers 32 rotate only in one direction and keeps gears in mesh for fold accuracy. Drive point 17 also drives an idler gear 200 for driving cutting cylinder pair 13, which then through a swing gear 26 can drive cutting cylinder pair 12. Drive point 17 thus drives a first loop including the cutting cylinder pairs 12, 13 and the first grippers 32 of cylinder 14. Due to phasing center 20, which is a double gear construction with a compound gear to alter a phase between the two gears of the phasing center, and idler gear 200, the phase between the cutting cylinder pair 12 and the first grippers 32 can also be altered.

A second drive point 18 drives tuckers 37 on a tucker spider. A phasing center 21 then drives first jaws 38 on a jaw spider, through an idler gear 210. Second grippers 39 are driven from first jaws 38. Second gripper 39 in turn drives idler 230 and an anti-backlash gear 25 to close the loop back to the pinion.

A second loop thus is driven by drive point 18, the second loop including the first tuckers 37, the first jaws 38 and the second grippers 39, all of which are on respective spider supports.

Drive point 19 drives idler gear 240 which in turn drives second tucker 46. Second tucker 46 then drives phasing center 22 to idler 220 to second jaw 47. Second jaw 47 then drives idler 250 and an anti-backlash center 24 to close the loop to pinion 19.

A third drive loop thus is driven by drive point 19, and includes second jaws 47 and second tuckers 46.

The motors 170, 180, 190 preferably are AC synchronous motors, which can track with fine resolution, match speed in real time, and hold position under load. Most preferably, one end of one or more of the drive motors is firmly supported with respect to the ground.

The three drive loops, which have respective drive points 17, 18, 19 each control one or more specific folder functions. The first drive loop controls a cut performed by the first and the second cut cylinder pairs 12, 13 and the first grip, performed by the first grippers 32; the second drive loop controls a first tuck performed by the first tuckers 37 into first jaws 38, which are then transferred to second grippers 39; and the third drive loop controls a second tuck performed by the second tuckers 46 into the second jaws 47.

In the cut to first grip procedure, the cut is an independent function, and the first grip is a dependent function, because the lead edge of the signature lies directly under one of the first grippers 32 when the signature is transferred. With the first tuck to first jaw to second grip procedure, the first tuckers 37, the first jaws 38, and the second grippers 39 are dependent on each other because when one of the first tuckers 37 tucks the signature, one of the first jaws 38 is in a receiving position, and when the first jaw 38 later releases the signature, one of the second grippers 39 is in the receiving position. Moreover, in the second tuck to second jaw procedure, since one of the second jaws 47 is in position to receive the signature when one of the second tuckers 46 extends to complete the second fold, dependency exists between the second jaws 47 and the second tuckers 46.

The independent drive loops afford a degree of freedom for phasing one set of functions to another set of functions, for example, the first tuckers 37 may shift relative to the first grippers 32 to effectuate lap adjustment without first tuckers 37 becoming out of phase with the first jaws 38. Lap adjustment changes the relative position of the lead edge of the signature as the lead edge falls on the tail edge after the fold. Through the phasing center 21, a group jaw adjustment within the second loop can optimize the transfer between tuckers 37 and jaws 38 and allows for varied product thickness.

During a first fold lap adjustment, the first tuckers 37 move from a nominal position relative to the first grippers 32. Through the motors 170, 180 for the first and second drive points 17, 18 and through indexing the second motor relative to the first motor, the first tuckers 37 move relative to the first grippers 32, with the first jaws 38 and second grippers 39 still being in proper position with respect to first tuckers 37. The first tuckers 37, first grippers 32, first jaws 38, and second grippers 39 are in appropriate positions when the signature is transferred. Thus, the position of the lead edge with respect to the fold of the signature, which is leaving the collect cylinder 14, can be changed. Moreover, by exaggerating the move of the first tuckers 37 with respect to the first grippers 32, a first mode change is accomplished, so that for example a delta fold can be accomplished.

The third drive loop may move relative to the second loop for a second fold lap adjustment. The second fold lap adjustment is similar to the first fold lap adjustment, however, the second fold lap adjustment is accomplished by indexing the third drive motor with respect to the second drive motor. A jaw adjust within the third loop is also possible with phasing center 24.

Each of the three drive loops is uniquely associated with one of three drive motors 170, 180, 190, one of the phasing centers 20, 21, 22, one of the anti-backlash devices 23, 24, 25, and at least one of the idlers 200, 210, 230, 240, 220, 250. Preferably, the anti-backlash devices 23, 24, 25 and the phasing centers 20, 21, 22 are compound gears with 1:1 ratios and opposite hand helix angles.

Each of the three drive loops maintains a distinct torque path: transmitting the torque from one of the drive points 17, 18, 19 to the components of the drive loop and then back to the drive point 17, 18, 19.

The first, second, and/or third drive loops may drive a mid-fold section, a quarter-fold section, and/or delivery section.

What is claimed is:

1. A method for cutting and folding printed products comprising the steps of:

driving with a first motor a first loop for cutting a signature and transferring the signature to a first gripper;

driving with a second motor a second loop for tucking the signature into a first jaw and transferring the signature to a second gripper; and driving with a third motor a third loop for tucking the signature into a second jaw.

2. The method as recited in claim 1 further including altering a phase between at least the first and second loops, so as to set a lap or perform mode change.

3. The method as recited in claim 1 further including using a phasing center to alter a phase between a tucker in the second loop and the first jaw so as to perform a group jaw adjust.

4. The method as recited in claim 1 further including using a phasing center to alter a phase between a tucker and a second jaw in the third loop so as to perform a group jaw adjust.

* * * * *